US006014839A

United States Patent [19]

Ruggles

[11] Patent Number: 6,014,839

[45] Date of Patent: Jan. 18, 2000

[54] ELECTRONIC ACTUATOR FOR ARCHITECTURAL SHUTTERS

[75] Inventor: Bryan K. Ruggles, Salt Lake City, Utah

[73] Assignee: Bryan Ruggles, Salt Lake City, Utah

[21] Appl. No.: 08/985,572

[22] Filed: Dec. 5, 1997

[51] Int. Cl.[7] ..... E06B 7/08

[52] U.S. Cl. ..... 49/74.1; 49/403; 49/25; 49/31

[58] Field of Search ..... 49/74.1, 82.1, 49/403, 73, 13, 25, 92.1, 31

[56] References Cited

U.S. PATENT DOCUMENTS

| | | | |
|---|---|---|---|
| 21,732 | 10/1858 | Babcock | 49/82.1 |
| 422,068 | 2/1890 | Cabus | 49/82.1 |
| 2,761,673 | 9/1956 | Cline | 268/23 |
| 2,952,049 | 4/1960 | Vetere | 20/57.5 |
| 2,954,590 | 10/1960 | Dynner | 20/62 |
| 3,177,367 | 4/1965 | Brown | 250/237 |
| 3,201,832 | 8/1965 | Hordois et al. | 49/82.1 X |
| 3,451,165 | 6/1969 | O'Hair | 49/87 |
| 3,571,973 | 3/1971 | Roberts | 49/31 X |
| 3,885,152 | 5/1975 | Anetseder, Sr. et al. | 250/235 |
| 4,020,276 | 4/1977 | Zittell | 49/87 |
| 4,203,566 | 5/1980 | Lord | 49/74.1 X |
| 4,279,240 | 7/1981 | Artusy | 126/419 |
| 4,435,920 | 3/1984 | Osaka et al. | 49/82.1 |
| 4,554,762 | 11/1985 | Anderson | 49/76 |
| 4,655,003 | 4/1987 | Henley, Sr. | 49/88 |
| 4,709,506 | 12/1987 | Lukaszonas | 49/88 |
| 5,187,896 | 2/1993 | Ross | 49/74.1 |
| 5,216,837 | 6/1993 | Cleaver et al. | 49/74.1 X |
| 5,379,551 | 1/1995 | Swapp | 49/74.1 X |
| 5,532,560 | 7/1996 | Element et al. | 318/266 |
| 5,548,925 | 8/1996 | Marocco | 49/74.1 |
| 5,580,307 | 12/1996 | Arosio et al. | 49/82.1 X |

*Primary Examiner*—Jerry Redman
*Attorney, Agent, or Firm*—Workman, Nydegger & Seeley

[57] ABSTRACT

An adjustable shutter assembly having an automated adjustment system including an electronic actuating device, such as an electric actuating motor. The shutter assembly has at least one and typically a plurality of parallel slats rotatably attached at both ends to a frame. The actuating motor is embedded within a self-contained module that can strengthen the shutter frame and be hidden from view. The actuating motor has a spindle that is coaxially connected to one end of an actuator slat selected from among the plurality of parallel slats. The spindle typically includes a tongue that engages a receiving pocket of the actuator slat without additional fastening mechanisms. One or more of the other slats are interconnected with the actuator slat such that rotation of the actuator slat is accompanied by substantially synchronous rotation of the other slats interconnected thereto. Selecting the actuator slat from among the more centrally located slats provides for more reliable and secure closure of all slats. It may be desirable to include one or more slats which move independently of the actuator slat, such as by manual movement or by another actuating motor. Various actuating mechanisms for actuating the motor and for causing the spindle of the motor to stop rotating may be used, such as light-sensitive actuators, timed actuators, remote actuators, or manually operated actuators. A plurality of shutter assemblies can be synchronized to open or close in concert. The actuating device provides for ease of installation in a wide variety of differently sized shutter assemblies.

28 Claims, 5 Drawing Sheets

ELECTRONIC ACTUATOR FOR ARCHITECTURAL SHUTTERS

BACKGROUND OF THE INVENTION

1. The Field of the Invention

The present invention relates to louvered shutter assemblies. More particularly, the invention relates to an adjustable framed shutter assembly having an electric motor attached to one of a plurality of slats whereby the plurality of slats may be rotated to open and close the shutter assembly.

2. Relevant Technology

Adjustable blinds or shutters have been used for generations in windows or other structural openings to selectively allow or prevent passage of air or light therethrough. A typical shutter includes a number of substantially parallel slats that may be rotated about their longitudinal axes. The angle of inclination of the slats may be selected such that the shutter is in a closed position wherein a minimum amount of light and air is permitted to pass through, an open position wherein a maximum amount of light and air is permitted to pass through, or any intermediate position therebetween.

There are at least two types of conventional shutters. First, framed shutters have slats rotatably attached at both ends to a frame. Generally, a rigid member, such as a control bar, is pivotally attached to each of the slats to cause the slats to rotate in unison. In framed shutters, the frame supports the slats and prevents movement thereof except for rotation about the longitudinal axes. Framed shutters commonly have slats with either horizontal or vertical axes of rotation.

Second, suspended blinds are characterized by two or more flexible members, such as cords or ladder assemblies, by which the slats are suspended or supported. The slats of suspended blinds are rotated by manipulating the flexible members, which in turn cause coordinated rotation of the slats. Slats of suspended blinds generally have only horizontal axes of rotation.

In many situations, it is desirable to provide adjustable shutters that may be opened and closed in ways other than through direct manipulation by a user. This is particularly true when shutter assemblies are especially large or in locations that are not easily accessible, or are present in such number that manually adjusting each of them would be cumbersome. In these and other cases, it would be useful to have shutters that could be adjusted automatically. In particular, there has been a general trend in recent years of providing "smart homes" in which various fixtures and appliances in houses are automated. Automatic shutter assemblies would increase the comfort and convenience of the surroundings in a house, and may even conserve energy and reduce heating and cooling expenses by optimizing the amount of solar radiation entering the house.

The problem of providing automated shutter assemblies has been approached in several ways. One example is seen in U.S. Pat. No. 4,554,762 to Anderson wherein an electric motor is positioned to rotate the slats of a sun blind for motor vehicles. The type of shutters that are modified in Anderson are suspended shutters as described herein. In particular, the electric motor is attached to one of two flexible ladder assemblies that support the slats. An event such as ignition of the vehicle triggers activation of the electric motor which adjusts the position of the ladder assembly. Movement of the ladder assembly causes synchronized rotation of the slats.

Another system for rotating slats of suspended shutters is disclosed in U.S. Pat. No. 5,532,560 to Element et al. In Element et al. an electric motor is used to adjust the cords from which the slats are suspended. Movement of the cords in turn causes the slats to rotate in unison. The electric motor of Element et al. is activated, for example, by a photosensitive sensor in response to a predetermined amount of light. Like Anderson, Element et al. presents an approach to the problem of automating the opening and closing of suspended shutters. Both Anderson and Element et al. disclose systems for manipulating or displacing the flexible members that support the slats of suspended shutters. Although Anderson and Element et al. each provide a system that is generally suitable for automating suspended shutters, their approaches are simply not applicable to framed shutters. Framed shutters generally do not include flexible members such as cords or rung assemblies that are required in Anderson and Element et al.

There have also been attempts directed specifically to automatically adjusting framed shutters. An example is disclosed in U.S. Pat. No. 3,177,367 to Brown. In particular, Brown discloses an electric motor that causes linear movement of an elongated rack. The rack is attached to a control rod which is pivotally connected to each of the slats. Upon activation of the electric motor, the rack and the control rod move vertically, thereby causing synchronized rotation of the slats. In effect, Brown provides the movable rack as the functional equivalent of a hand of a person manually adjusting the shutters. The movable rack is positioned in front of the shutters so as to access the control bar.

Several problems with Brown are readily apparent. First, the motor and rack assembly must be positioned in front of the shutters, and consequently, directly in front of any window in which the shutters are used. Any benefits of convenience gained by using Brown will probably be outweighed by the prominent and unsightly positioning of the motor. Additionally, it will be understood that with any of the foregoing approaches, the motor that adjusts the shutters must be connected not only to the shutter assembly, but also to a fixed reference point. In the case of Brown, the motor cannot simply be attached to the control rod, but there must be some support frame or truss that connects the motor to a fixed point on a nearby wall. The combination of a support frame and the unaesthetic positioning of the motor would limit Brown's acceptance in applications where appearance is important, especially in the domestic environment.

The foregoing systems of the prior art for automating the adjustment of shutters fall short of providing a suitable system that may be used for framed shutters. The prior art systems are directed only to suspended shutters or employ an automated adjustment system that significantly detracts from the function and appearance of the shutters.

In view of the foregoing, it would be a significant advancement in the art to provide a framed shutter assembly having an actuating assembly that is substantially disposed within the frame of the shutter assembly such that the actuating assembly is substantially hidden from view.

It would also be desirable to provide a system that can selectively, smoothly, and uniformly move slats to any of a number of possible angles of inclination.

Additionally, it would be desirable in many instances to have a system in which movement of multiple framed shutter assemblies may be coordinated.

There is also a need for a framed shutter assembly that may be automatically adjusted in response to one or more of a wide variety of user actions or external events.

It would further be an improvement in the art if the actuating assembly was self contained module that could act to strengthen a shutter frame that has been structurally altered to house the actuating assembly module.

Further, it would be advantageous to provide an actuating assembly that was sized so that it could be universally used with differently sized shutters in order to obviate the need to radically change the design of the actuating assembly to fit a particular manufacturer's shutter design.

In addition, it would be an improvement in the art to provide an actuating assembly that is a self-contained module with a spindle configuration which together facilitate installation of the actuating assembly within the shutter at the time of manufacture of the shutter.

There is also a need for an actuating assembly that is able to ensure that all of the louvers of a shutter assembly can be substantially tightly closed notwithstanding the play that may exist between the different louvers or slats, particularly those that are farthest apart.

Such systems and apparatus for providing automated adjustment of a framed shutter assembly are disclosed and claimed herein.

BRIEF SUMMARY AND OBJECTS OF THE INVENTION

The present invention relates to adjustable shutter assemblies. More particularly, the invention relates to an adjustable framed shutter assembly having an electric motor attached to one of a plurality of slats that may be rotated to adjust the shutter assembly. The framed shutter assembly of the invention includes slats that are rotatably attached at both ends to a frame. The slats may each be connected to a control bar or other suitable mechanism for providing synchronized rotation of the slats. One of the slats is selected as an actuator slat. Preferably, the actuator slat is located near the middle of the slats, for example, within the middle third of the slats. Most preferably, the actuator slat is located as near to the middle slat as possible.

An actuating assembly including an electronic actuating motor and a rotatable spindle is disposed substantially within the frame of the shutter assembly such that the spindle is coaxially aligned with the axis of rotation of the actuator slat. Tcil spindle is coupled to an end of the actuator slat such that rotation of the spindle causes rotation of the actuator slat. More specifically, the actuator slat preferably includes a receiving pocket or recess configured to receive the spindle therewithin in a manner that obviates the need for additional mechanical fasteners to secure the spindle and actuator slat together. Accordingly, when the motor is actuated to rotate the spindle, each of the slats of the shutter assembly interconnected with the actuator slat will be caused to rotate substantially in unison with the spindle and the actuator slat.

The actuating motor of the invention may be advantageously embedded or enclosed within the frame such that it is substantially hidden within the frame. In this manner, the actuating motor is placed substantially out of sight of a person viewing the shutter assembly. It will be appreciated that the shutter assembly may be automatically adjusted while avoiding the unaesthetic motor and associated adjustment system that is taught by Brown. Since providing a hollowed out portion of the frame may cause substantial weakening of the frame, the actuating motor is preferably encased within a module that is configured to strengthen the frame in order to maintain the structural integrity of the frame.

According to the invention, the slats of the shutter assembly may be adjusted to substantially any angle of inclination within the operating range thereof The actuating assembly is configured so that rotation of the spindle may be selectively stopped in a desired position in order to maintain a selected angle of inclination. In particular, the actuating assembly may contain position sensors in conjunction with microswitchcs so that the spindle will rotate only within selected definitive boundaries. Accordingly, rotation of the spindle is limited so as not to damage the slats or other elements of the shutter assembly.

Furthermore, the actuating assembly of the invention may be configured to prevent rotation of the spindle so that the slats are locked in place when the actuating motor is turned off or otherwise deactivated. Alternatively, a clutch mechanism may be provided for disengaging the spindle so that the shutter assembly may be manually adjusted as desired using the control bar. The size of the actuating motor may be selected so that the motor may drive shutter assemblies having any of a plurality of different dimensions and/or torque requirements. Additionally, the invention may include a coordinating module whereby the actuating assembly of one shutter assembly may be linked electronically with the actuating assemblies of other shutter assemblies to provide synchronized or coordinated movement of multiple shutter assemblies.

The invention is sufficiently flexible to allow the actuating assembly to be activated and the shutters to be adjusted according to any of a number of possible events. For example, there may be provided a manual switch actuator to selectively direct power to the actuating motor. Alternatively, a photosensitive sensor may be included to trigger activation of the actuating motor in response to light. The actuating assembly may also include a remote control actuator so that a user may adjust the actuating assembly from a remote location such as across a room. Still further, the actuating assembly may include a timed actuator to adjust the shutter assembly at one or more selected times.

In one embodiment of the invention, the slats of the framed shutter assembly are divided into multiple groups. Each group of slats is attached to a separate actuating assembly. Accordingly, each of the multiple groups has the capability of opening and closing independently from other groups. It may also be desirable to include one or more slats which move independently of any actuator slat such that such slats can be moved manually.

In view of the foregoing, it is an object of the invention to provide a framed shutter assembly having an actuating assembly that is substantially disposed within the frame of the shutter assembly such that the actuating assembly is substantially hidden from view.

In addition, another object of the invention is to provide an adjustment system that can selectively, smoothly, and uniformly move slats to any of a number of possible angles of inclination.

An additional object of the invention is to optionally provide a system in which movement of multiple framed shutter assemblies may be coordinated.

A further object of the invention is to provide a framed shutter assembly which may be automatically adjusted in response to one or more of a wide variety of user actions or external events.

Another object of the present invention is to provide an actuating assembly that is a self-contained module that acts to strengthen a shutter frame that has been structurally altered to house the actuating assembly module, such as a shutter frame that has been hollowed out to receive the actuating assembly.

It is yet a further object to provide an actuating assembly that is sized so that it can be universally used with differently sized shutters in order to obviate the need to radically change the design of the actuating assembly to fit a particular manufacturer's shutter design.

An additional object of the present invention is to provide an actuator assembly that is a self-contained module with a spindle having a tongue which together facilitate installation of the actuating assembly within the shutter at the time of manufacture of the shutter.

Finally, it an object to provide an actuating assembly that is able to ensure that all of the louvers of a shutter assembly can be substantially tightly closed notwithstanding the play that exists between the different louvers or slats, particularly those that are farthest apart.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to an electronic actuating system that can be used with a framed shutter assembly in order to adjust the position of the slats or louvers. The slats of the shutter assembly are typically rotatably attached at both ends to a frame. An actuator slat is selected from among the plurality of slats. An electronic actuating assembly including an electric actuating motor and a rotatable spindle is positioned such that the spindle is coaxially aligned with the axis of rotation of the actuator slat. Rotation of the spindle causes corresponding rotation of the actuator slat. Some or all of the slats of the shutter assembly are connected with a control bar or other suitable mechanism such that rotation of the actuator slat causes rotation of a desired number of the slats. Accordingly, activation of the electronic actuating assembly will result in adjustment of one or more slats within the shutter assembly. Alternatively, a plurality of actuating assemblies may be attached to multiple groups of slats, thereby permitting each group to be adjusted independently of the other groups.

Figure 1:
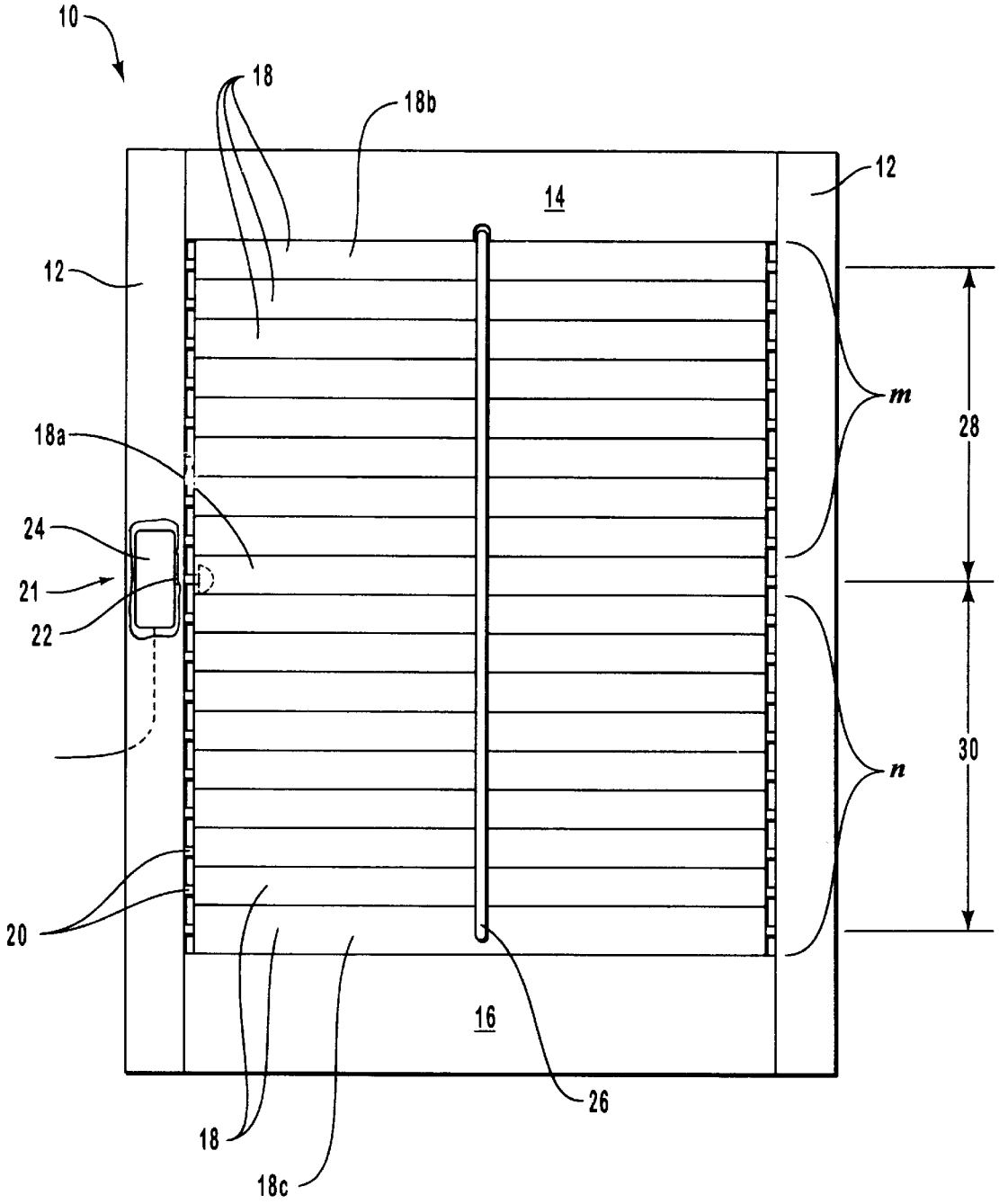
FIG. 1 is a front elevation view of a shutter assembly in which the slats have horizontal axes of rotation.

FIG. 1 illustrates a conventional shutter assembly used in combination with the electronic actuating assembly of the present invention. Shutter assembly 10 includes a pair of stiles 12 that are parallel one to another and extend vertically. A top rail 14 and a parallel bottom rail 16 extend between stiles 12. Together, stiles 12, top rail 14 and bottom rail 16 constitute the frame of shutter assembly 10. The frame may be constructed of any suitable material or combination of materials, including, but not limited to, wood, metal, plastics, ceramics, and combinations thereof.

One or more slats 18 are rotatably attached at both ends to stiles 12 using pivot members 20 which may be, for example, dowels, bearings or the like. Typically the frame is rectangular, as seen in FIG. 1, and defines an "interior region" within which slats 18 are disposed. However, the invention extends to a frame of any configuration to which both ends of slats 18 may be rotatably attached. Preferably, slats 18 are dimensionally uniform one with another. While slats 18 are preferably constructed of wood, other materials such as metal, plastics, ceramics and the like may be used. Slats 18 provide means for selectively adjusting the quantity and/or intensity of light and air that is permitted to pass through a window to which the shutter assembly is attached.

An actuator slat 18*a* is selected from among slats 18. One end of actuator slat 18*a* is connected to an actuating assembly 21 including a spindle 22 connected to an electronic actuating device, such as an electric motor 24. Spindle 22 communicates between electric motor 24 and actuator slat 18*a* such that rotation of spindle 22 causes corresponding rotation of actuator slat 18*a*. Alternatively, spindle 22 can be connected to another type of electronic actuating device, such as a solenoid or other electronically actuated device that can cause rotation of spindle 22, such as devices using a magnetic or electric field to cause appropriate movement (not shown).

As seen in FIG. 1, motor 24 is preferably embedded or enclosed within one of stiles 12. In this manner, motor 24 can be substantially hidden from view. Of course, the invention may also be practiced with part or all of motor 24 being exposed to view. Actuating assembly 21 provides electronic actuating means for selectively rotating, or actuating, one or more slats of the shutter assembly 10. The actuating assembly 21 is preferably encased within a rigid housing which, when secured within the hollowed-out portion of the stile 12, acts as a rigid support or reinforcement to the stile 12 such that the structural integrity of the shutter assembly 10 is not significantly compromised. Providing activating assembly 21 within a self-contained module with spindle 22 together facilitate installation of the actuating assembly 21 within stile 12 of shutter assembly 10 during manufacture of shutter assembly 10.

The actuating motor 24 or other electronic actuating device, such as a solenoid or other electronically actuated device that can deliver a force for rotating actuating slat 18*a*, e.g., devices that respond to a magnetic or electric field to cause appropriate movement, provide means for providing an actuating force. The spindle 22 provides means for transferring said actuating force from said actuating device to said actuator slat 18*a*. In the case where the actuating force is oriented such that it is substantially aligned or coterminous with the desired movement of actuating slat 18*a*, the means for transferring said actuating force from said actuating device to said selected slat can be a substantially axially aligned spindle, such as spindle 22.

On the other hand, it is possible that the actuating force will not be aligned with the desired movement of actuator slat 18*a*. In that case, the means for transferring said actuating force from said actuating device to said actuator slat 18*a* will need to have means for converting such nonaligned forces into aligned forces that are substantially aligned with, or at least capable of causing, the desired movement of actuator slat 18*a*. An example of such force transferring means could be some sort of universal joint (not shown), such as is used in many different mechanical systems to transfer the direction of forces, e.g., automobile transmissions. Such universal joints are well known to those of ordinary skill in the art such that one could easily adapt an appropriate force transfer mechanism that would work within the electronic actuating assembly of the present invention to carried out the desired purpose.

As used herein, "actuation" refers to an event that causes motor 24, or other electronic actuating means, to actuate or actively drive and cause rotation of spindle 22. Actuation may result from initiation of delivery of electrical power to motor 24 or by a subsequent action by which rotation of spindle 22 is initiated. "Deactivation" as used herein refers to an event that causes motor 24 to stop actively driving and causing rotation of spindle 22. Deactivation may result from termination of delivery of electrical power to motor 24, or other electronic actuating means, or by another event that causes motor 24 to no longer actively cause rotation of spindle 22.

Slats 18 are typically arranged in a substantially parallel fashion and consist of an actuator slat 18*a* and one or more secondary slats (FIG. 1). Alternatively, a framed shutter assembly may include multiple groups of interconnected slats, each group having an actuator slat 18*a* and secondary slats such that different groups of slats 18 can move independently of each other or in unison as desired.

Within each selected group of related slats, actuator slat 18*a* and the secondary slats are interconnected by a structure that provides means for substantially synchronizing rotation of the secondary slats with actuator slat 18*a* such that rotation of actuator slat 18*a* through a selected angle is accompanied by substantially simultaneous rotation of each of the secondary slats through an angle approximately equal to the selected angle. As one example of such means for synchronizing rotation, control bar 26 is provided as illustrated in FIG. 1. Control bar 26 is substantially rigid and is pivotally attached to each of slats 18 in order to cause slats 18 to rotate in a substantially synchronous manner. However, other suitable mechanisms for causing substantially synchronized rotation of slats 18 may be used in the present invention.

Although any of slats 18 may be selected as actuator slat 18*a*, it has been found that slats 18 of shutter assembly 10 can be adjusted more easily, smoothly, and uniformly when actuator slat 18*a* is selected to be one of the middle of slats 18. This observation may be related to the structural properties of control bar 26 and the connections between control bar 26 and slats 18. There is typically some play between control bar 26 and each of slats 18. Movement of a slat that is relatively distant from actuator slat 18*a* is typically not as precisely coordinated with actuator slat 18*a* as is movement of a slat that is closer to actuator slat 18*a*. For example, uppermost slat 18*b* will generally respond somewhat less precisely to movement of actuator slat 18*a* than will the slat that is immediately adjacent actuator slat 18*a*. This may be a result of the cumulative effects of the play between control bar 26 and the intervening slats that are positioned between actuator slat 18*a* and uppermost slat 18*b*. It will be appreciated that this cumulative effect is reduced when actuator slat 18*a* is centrally located such that the distance between actuator slat 18*a* and the most distant slat 18 is minimized. This has the beneficial effect of balancing the mechanical forces on the various slats 18 during movement of the slats 18.

Accordingly, actuator slat 18*a* is preferably selected to be in the middle third of slats 18. More precisely, the position of actuator slat 18*a* may be described in reference to a first distance 28 and a second distance 30. First distance 28 is defined as the distance by which actuator slat 18*a* is vertically displaced from uppermost slat 18*b*. As used herein, first distance 28 is measured from the axis of rotation of actuator slat 18*a* to the axis of rotation of uppermost slat 18*b*. Second distance 30 is defined as the distance by which actuator slat 18*a* is vertically displaced from lowermost slat 18*c*. As used herein, second distance 30 is measured from the axis of rotation of actuator slat 18*a* to the axis of rotation of lowermost slat 18*c*. Actuator slat 18*a* may be said to be in the middle third of slats 18 when first distance 28 is no more than about two times greater than second distance 30 or when second distance 30 is no more than about two times greater than first distance 28.

Most preferably, actuator slat 18*a* is selected to be as near to the middle of slats 18 as possible. The position of actuator slat 18*a* may be defined by identifying the number of slats 18 that are positioned both above and below actuator slat 18*a*. In particular, the number of slats 18 positioned above actuator slat 18*a* is defined herein as m. The number of slats 18 positioned below actuator slat 18*a* is defined herein as n. Actuator slat 18*a* may be said to be as near the middle of slats 18 as possible when m and n are either equal or differ by only one. When there is an odd number of slats, m will equal n when actuator slat 18*a* is the most centrally positioned slat. When there is an even number of slats, m will differ from n by one slat when actuator slat 18*a* is one of the two most centrally positioned slats. When the actuator slat 18*a* is nearest the middle slat, the forces exerted on the slats 18 by the control bar 26 are more pivotally balanced so that leverage is more efficiently applied to each slat 18. This is preferable since it provides for substantially full closure of all slats 18.

Figure 2:
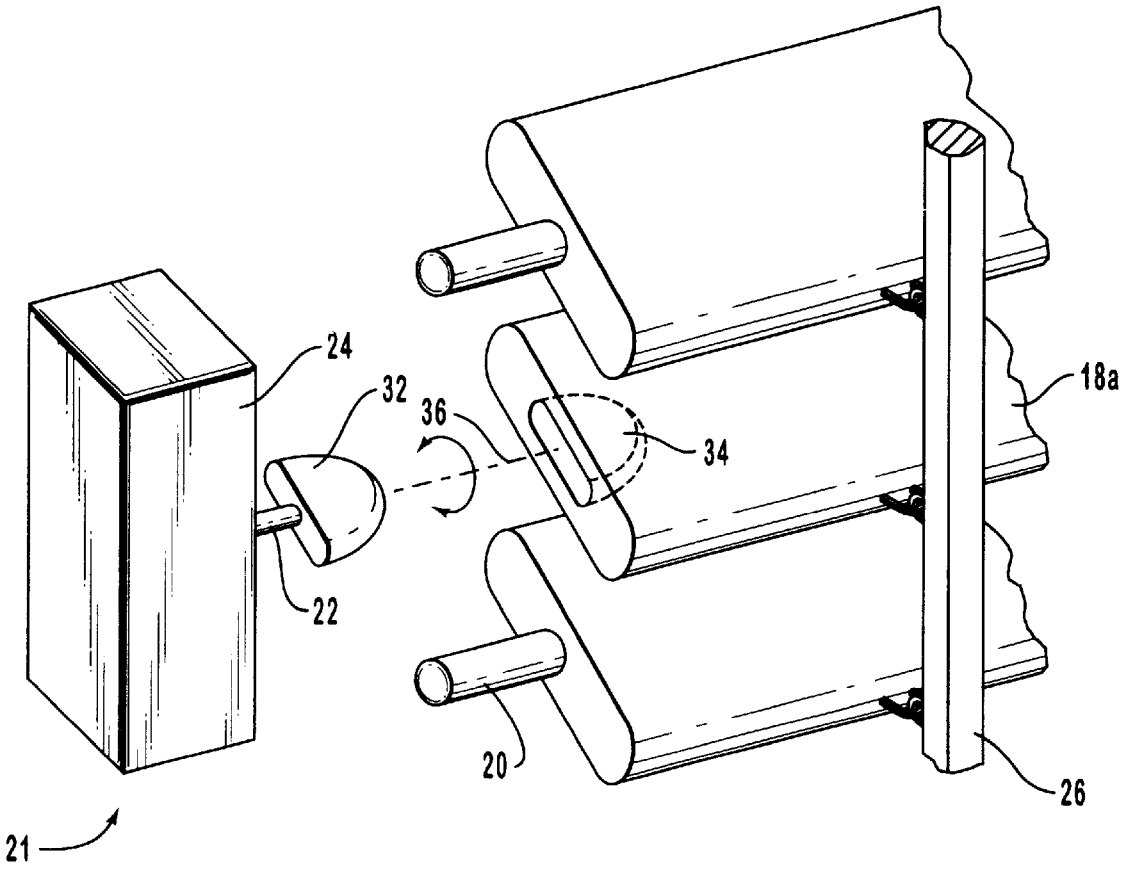
FIG. 2 is an exploded perspective view of an actuating motor having a spindle and a corresponding actuator slat.

Referring now to FIG. 2, the preferred manner in which spindle 22 is attached to actuator slat 18*a* is more clearly seen. A driving tongue 32 is attached to an end of spindle 22 distal to motor 24. A corresponding groove or receiving pocket 34 is provided within actuator slat 18*a* such that tongue 32 may be inserted into groove 34. Tongue 32 preferably has a shape that facilitates insertion within receiving pocket 34 within actuator slat 18*a*. In addition, the shape is preferably selected to efficiently transmit the rotational forces of spindle 22 to actuator slat 18*a* with minimal risk of breakage or disengagement between tongue 32 and slat 18*a*. Thus, spindle 22 and tongue 32 provide means for transferring rotational actuating force from actuating motor 24 to actuator slat 18*a*.

In a preferred design, tongue 32 will have a crescent or half moon shape, as depicted in FIG. 2. This shape is suitable because it allows the surface of tongue 32 to be rotationally locked into groove 34. This shape is also advantageous because it provides a relatively large bearing surface over which rotational forces can be distributed. Accordingly, mechanical failure of actuator slat 18*a* during normal operation is less likely. The curved shape of tongue 32 also fits within a simple groove that can be easily formed within actuator slat 18*a*, which facilitates installation of the actuating assembly 21. It will be appreciated, however, that a large number of shapes and dimensions of tongue 32 and corresponding receiving pocket 34 may be suitable depending on the size and configuration of the slats 18 and/or the shutter 10. By way of example, and not by limitation, tongue 32 could be triangular, rectangular, hexagonal, octagonal, star shaped, cam shaped, or the like. Such shapes of receiving pocket 34 can be formed using tools that are well-known and readily available to those of ordinary skill in the art.

As can be seen in FIG. 2, spindle 22 is preferably coaxially aligned with axis of rotation 36 of actuator slat 18*a*. Thus, in a preferred embodiment rotational movement of spindle 22 is directly converted into substantially similar rotational movement of actuator slat 18a without the need for intervening linkages, pulleys, windings, and the like. Spindle 22 and tongue 32 are preferably configured so that tongue 32 can mate with actuating slat 18*a* in a manner that eliminates the need for additional mechanical fasteners to secure spindle 22 and actuator slat 18*a* together, although it would certainly be within the scope of the invention to use secondary fastening means.

Figure 3:
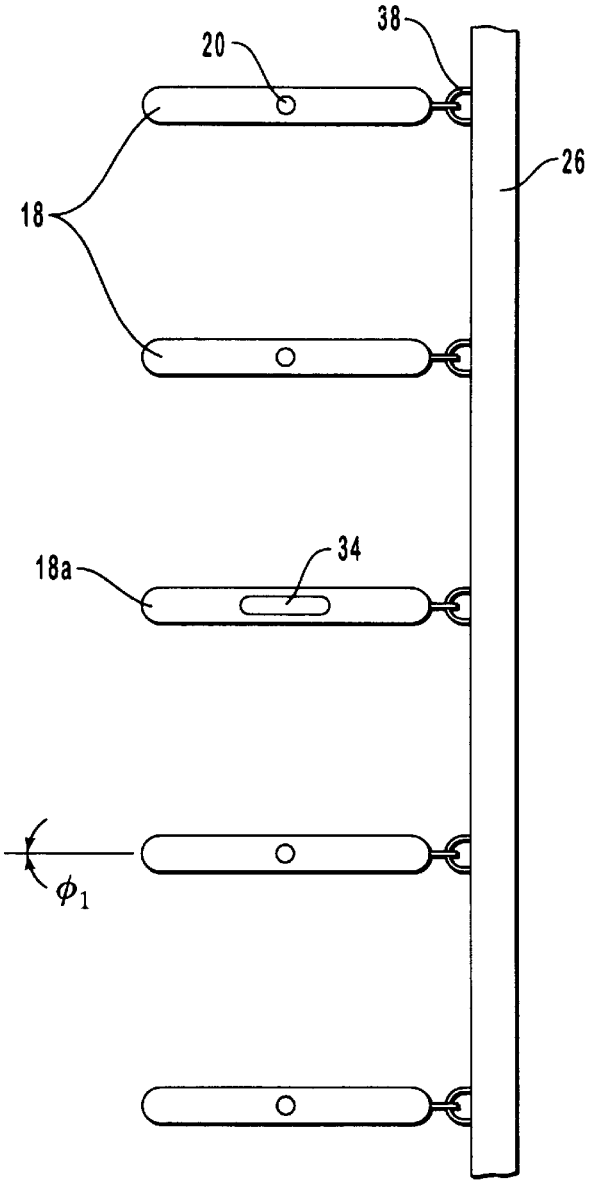
FIG. 3 is a partial side elevation view of the shutter assembly of FIG. 1 showing the slats in an open position.
Figure 4:
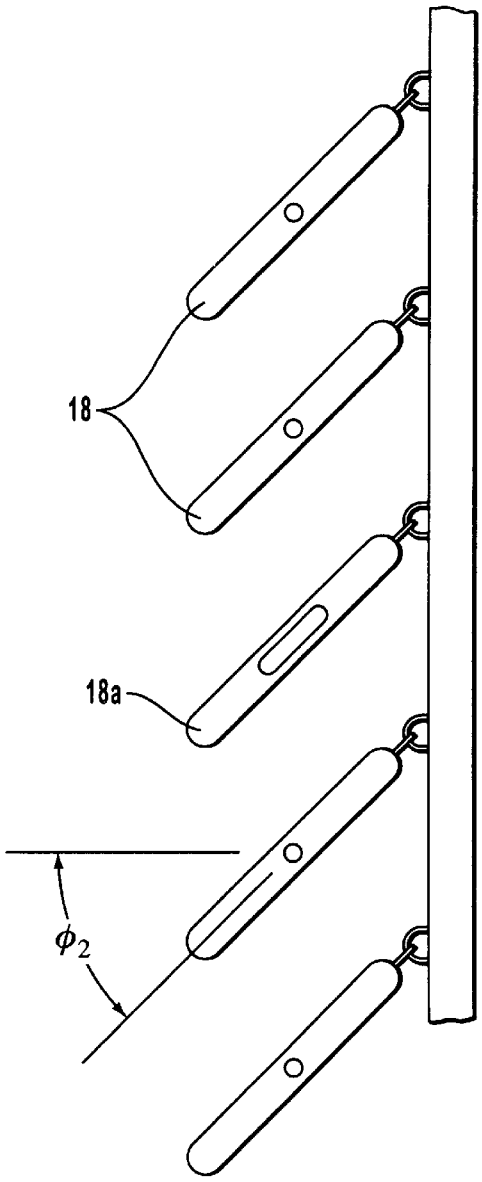
FIG. 4 is a partial side elevation view showing the shutter assembly of FIG. 3 after the slats have been rotated to a substantially closed position.

FIGS. 3 and 4 illustrate the manner in which control bar 26 can be configured to cause slats 18 to simultaneously rotate in unison in response to rotation of actuator slat 18*a*. FIG. 3 is a partial side elevation view of several of slats 18 in an open position. In the open position, slats 18 allow a relatively large amount of light or air to pass therethrough. In this position slats 18 have an angle of inclination that substantially coincides with a horizontal plane depicted as plane angle $\phi_1$. Of course, any fixed reference angle may be used to measure the angle of inclination of slats 18. The horizontal plane angle $\phi_1$ is selected in the example for convenience.

FIG. 4 depicts slats 18 of FIG. 3 after they have been rotated in response to rotation of actuator slat 18*a* to a substantially closed position. As can be seen, actuator slat 18*a* is connected to control bar 26 by a bar coupling 38. Control bar 26 moves in response to rotation of actuator slat 18*a*. Since control bar 26 is likewise pivotally attached to each of slats 18, movement of control bar 26 causes each of slats 18 to move in substantial unison. Slats 18 of FIG. 4 have an angle of inclination $\phi_2$ such that they are displaced from the horizontal plane by a rotational angle $\theta$. Thus, comparing FIG. 1 to FIG. 3, slats 18 have been angularly displaced from a first position to a second position through an angle of rotation $\theta$ that is defined by the relationship $\theta=\phi_2-\phi_1$, where $\phi_1$ depicts the first plane angle that is substantially horizontal and $\phi_2$ depicts a second plane angle corresponding to the average angle of orientation of the slats 18.

The shutter assembly of the invention is preferably configured such that motor 24 and spindle 22 can produce substantially any desired angle of rotation of slats 18 within the operating range thereof. It will be understood that the operating range of slats 18 should generally be limited by the angles of inclination at which one slat makes contact and begins to interfere with a neighboring slat. For example, movement of spindle 22 can be constrained to remain in the operating range of slats 18 by including position sensors and microswitches in actuating assembly 21.

Figure 5:
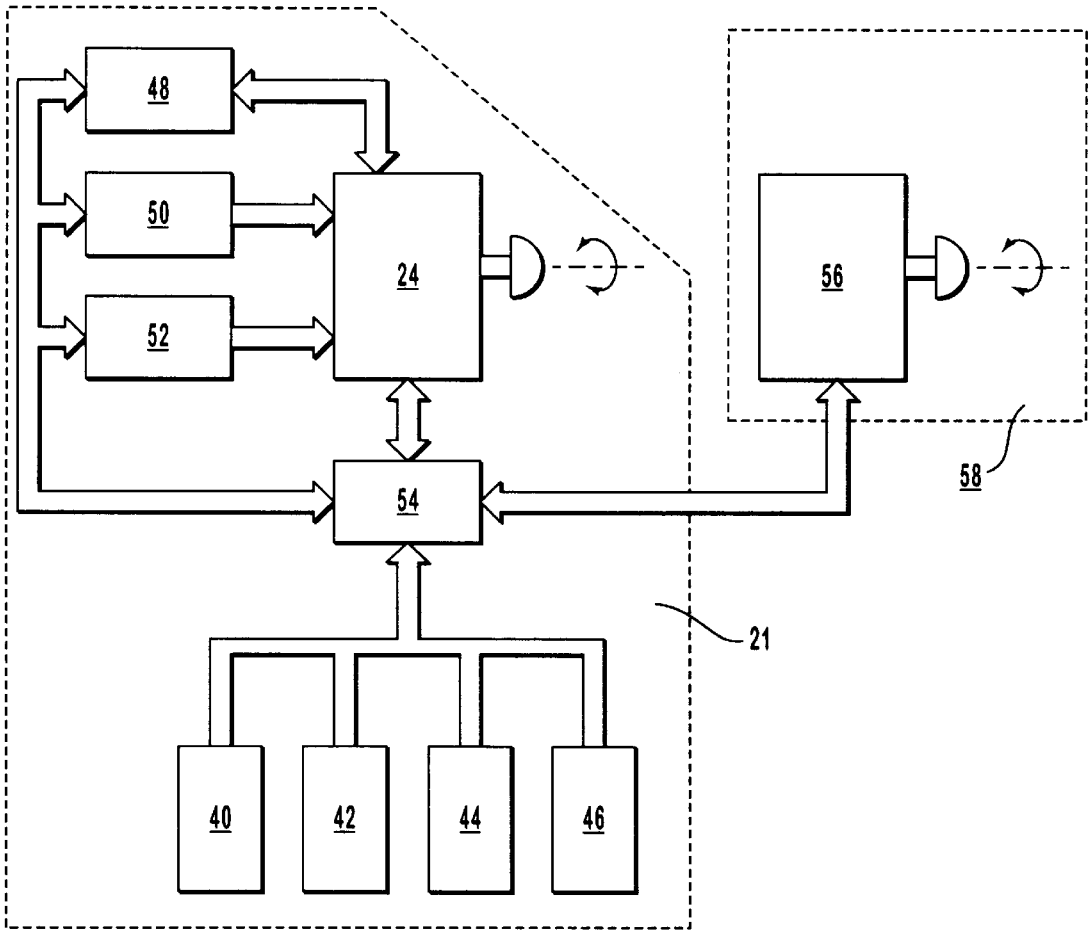
FIG. 5 is a schematic illustration showing the relationship of the actuating motor with various elements and features of the invention.

The schematic drawing of FIG. 5 illustrates the relationship of motor 24 with various actuating, control, and other elements that may be included in the actuating assembly 21 of the invention. Any suitable powering means for actuating motor 24 such that spindle 22 can be rotated as desired may be used within the present invention. By way of example, and not by limitation, such powering means for actuating the motor 24 may include one or more of timing means for actuating the motor at a predetermined time, remote means for actuating the motor from a remote location, photosensitive means for actuating the motor in response to light, and mechanical switching means.

One example of timing means is timed actuator 40, with which a user may select certain times at which the shutter assembly 10 is to be automatically adjusted. Timed actuator 40 may include, for example, any desired mechanical timer or clock, electronic component, computer processor hardware, software, or the like. Timed actuator 40 may comprise any timing means for actuating the electronic actuating means at a desired time, such as a timer.

An example of remote means is remote actuator 42, by which a user can adjust the shutter assembly from a distance. Hard wired, infrared, and other remote mechanisms for actuating an electric motor are well-known in the art. Additionally, remote actuator 42 may include computer processor hardware, software or the like. Remote actuator 42 may comprise any remote means for actuating the electronic actuating means from a remote location, such as a remote control.

Photosensitive actuator 44 is but one example of photosensitive means. Photosensitive actuator 44 may be programmed so that a predetermined intensity of outdoor or indoor light will trigger photosensitive actuator 44 to initiate adjustment of the shutter assembly 10. Photosensitive actuator 44 may include, for example, one or more photovoltaic cells or other photosensitive sensors. Optionally, photosensitive actuator 44 may include computer processor hardware, software or the like. Use of photosensitive actuator 44 could allow the shutter assembly 10 to be automatically opened or closed at selected times of the day such as sunrise or sunset. Upon learning of the invention as disclosed herein, one skilled in the art will understand how to adapt a photosensitive sensor to actuate motor 24 in a desired manner. Photosensitive actuator 44 may comprise any photosensitive means for actuating the electronic actuating means in response to changes in the intensity of light, such as a photosensitive switch.

The means for actuating the motor may also include any other desired actuating mechanism, such as switch actuator 46, which allows a user to manually turn on motor 24 as desired to adjust the shutter angle. Switch actuator 46 may include any desired mechanism by which electrical power may be selectively directed to motor 24. For example, switch actuator 46 may simply include structure for selectively opening and closing a circuit. Switch actuator 46 may also include computer hardware, software or the like. Switch actuator may comprise any switch means for actuating the electronic actuating means in response to mechanical action by the user, such as a manual switch.

The invention may be practiced with any of various combinations of actuators 40, 42, 44 and 46 for actuating the electronic actuation means or, alternatively, with an actuating mechanism other than those specifically identified in FIG. 5, either alone or in combination with one or more of actuators 40, 42, 44 and 46.

As previously disclosed, the actuating mechanism, such as one or more of actuators 40, 42, 44, and 46, may include or be associated with computer processor hardware, software, or a combination thereof. For example, a standalone or networked personal computer or microprocessor may be part of the actuator mechanisms disclosed herein. Accordingly, the present invention extends to embodiments used in "smart homes", in which multiple fixtures and appliances can be automated and centrally controlled. One skilled in the art, upon learning of the invention, will understand how to configure and program a computer system to coordinate and control adjustment of the actuating assembly.

The actuating assembly 21 preferably includes means for causing the spindle of motor 24 to stop rotating such that the actuator slat 18*a* maintains a desired angle of inclination selected from a plurality of possible angles of inclination. Such means for causing the spindle to stop rotating may take one of several forms. For example, such means may be an angle determination module 48 that monitors the angle of actuator slat 18*a* as it rotates. Upon reaching a predetermined angle of inclination, angle determination module 48 causes motor 24 to deactivate, thereby providing the desired angle of the shutter assembly.

Alternatively, the means for causing the spindle to stop rotating may be incorporated into an actuator mechanism such as those shown at 40, 42, 44, and 46. For example, if a switch actuator mechanism 46 is used, the spindle could be caused to stop rotating by flipping the switch to turn off motor 24. In any event, there will preferably be included some mechanism that provides means for stopping rotation of the spindle when slats 18 have reached a desired angle of inclination.

There may be included in the invention means for rotatably disengaging spindle 22 such that an angle of inclination of actuator slat 18*a* may be selected from a plurality of possible angles of inclination using control bar 26 substantially without interference from motor 24. Such means are useful to allow a user to bypass the automated adjustment system described herein and to manually adjust the shutters by hand. By way of example, and not by limitation, a clutch mechanism 50 may provide means for disengaging spindle 22. Clutch mechanism 50 may be configured to allow spindle 22 to spin freely and independently of the position of motor 24. Upon learning of the disclosure made herein, one skilled in the art will understand how to provide a suitable clutch mechanism 50 for disengaging spindle 22.

In a preferred embodiment, the shutter assembly may include means for fixing actuator slat 18*a* in a desired angle of inclination selected from a plurality of possible angles of inclination when motor 24 is deactivated. Such means prevent slats 18 from freely rotating when motor 24 is turned off or otherwise deactivated. As an example of such means for fixing slats 18 within a desired and locked orientation, angle fixing module 52 may be provided. Angle fixing module 52 may include, for example, a braking or locking mechanism to prevent spindle 22 from rotating when motor 24 is in a deactivated mode.

In some applications of the present invention, it may be desirable to coordinate the driving movement of motor 24 of shutter assembly 10 with a second motor 56 included in a second shutter assembly. Accordingly, means for coordinating actuation of motor 24 with the actuation of second motor 56 may be included in the shutter assembly. By way of example, and not by limitation, coordinating module 54 may provide such means for coordinating, and/or for processes various inputs. Coordinating module 54 may include a mechanical or electrical linkage, an electronic component, microprocessor hardware or software, and other similar device by which two or more actuating motors may be coordinated. Coordinating module 54 may be disposed either internally within, or externally to, the module encasing motor 24.

Figure 6:
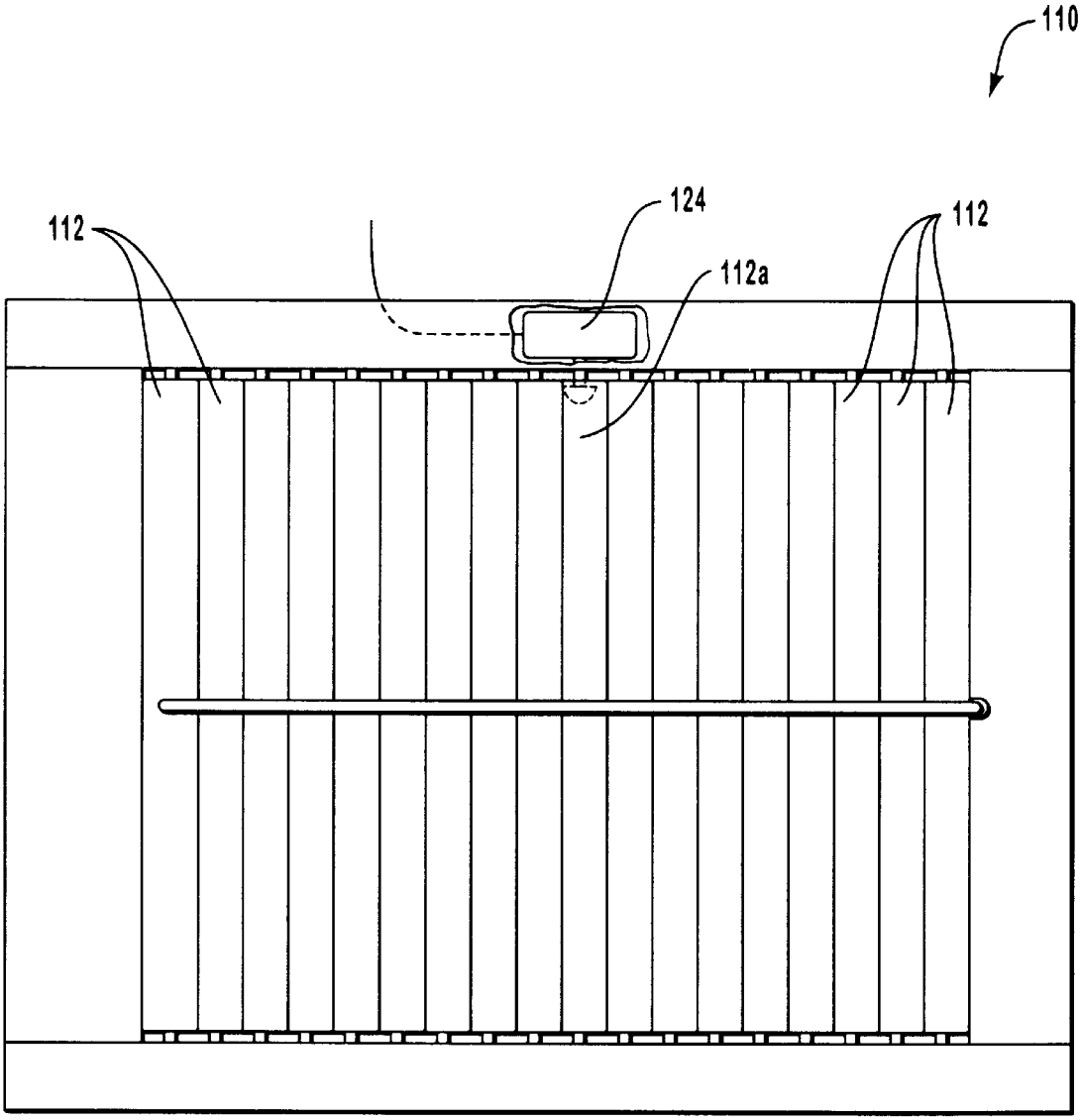
FIG. 6 is a front elevation view of a shutter assembly in which the slats have vertical axes of rotation.

FIG. 6 depicts an alternate embodiment of the invention wherein shutter assembly 110 has a plurality of slats 118 that extend vertically within a frame. Slats 118 are driven by an actuator slat 118*a* that is linked to a motor 124. Shutter assembly 110 is substantially structurally equivalent to shutter assembly 10 of FIG. 1 with the exception of the vertical orientation of slats 118. Accordingly, the foregoing detailed description of FIGS. 1–5 is substantially applicable to shutter assembly 110 of FIG. 6.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An electronic actuating system in combination with a shutter assembly having at least one slat rotatably disposed within an interior region defined by a frame of the shutter assembly, said electronic actuating system comprising an electronic actuating assembly for selectively rotating a selected slat of the shutter assembly, said electronic actuating assembly including:

an electronic actuating device at least partially disposed within a corresponding recess in the frame of the shutter assembly and capable of producing actuation forces, the electronic actuating device being housed within an encasement which provides structural reinforcement of the frame; and a drive spindle having an end configured so as to mate with a corresponding recess in the selected slat and communicating between the electronic actuatiing device and the selected slat so as to convert actuation forces produced by the electronic actuating device into desired rotational movement of the selected slat.

2. An electronic actuating system in combination with a shutter assembly as defined in claim 1, wherein the drive spindle is substantially coaxially aligned with the selected slat.

3. An electronic actuating system in combination with a shutter assembly as defined in claim 1, wherein the drive spindle further includes a tongue disposed at an end thereof which is mated with the corresponding recess in the selected slat.

4. An electronic actuating system in combination with a shutter assembly as defined in claim 1, further comprising powering means for selectively actuating the electronic actuating device as desired.

5. An electronic actuating system in combination with a shutter assembly as defined in claim 4, wherein the powering means includes a device selected from the group consisting of a timer, a remote control, a photosensitive switch, a mechanical switch, and combinations thereof.

6. An electronic actuating system in combination with a shutter assembly as defined in claim 1, wherein said shutter assembly includes a plurality of slats in addition to the selected slat mated with the drive spindle.

7. An electronic actuating system in combination with a shutter assembly as defined in claim 6, further including a control bar for substantially synchronizing movement of the plurality of slats and the selected slat.

8. An electronic actuating system in combination with a shutter assembly as defined in claim 7, wherein the selected slat is located approximately centrally with respect to the plurality of slats.

9. An electronic actuating system in combination with a shutter assembly as defined in claim 6, wherein at least one of the plurality of slats is capable of rotating independently of selected slat.

10. An electronic actuating system combination with a shutter assembly as defined in claim 6, wherein the selected slat is located within a middle third of the plurality of slats.

11. An electronic actuating system in combination with a shutter assembly as defined in claim 1, further comprising means for rotatably disengaging the drive spindle from the electronic actuating device such that the selected slat can be manually adjusted to a desired angle of inclination without substantial interference from the electronic actuating device.

12. An electronically actuated shutter assembly comprising:

a frame defining an interior region;

a plurality of slats rotatably disposed within said interior region of said frame, at least one of said slats comprising an actuator drive slat, wherein said actuator slat has an axis of rotation and a receiving pocket disposed at an end of said actuator slat;

an electronic actuating device at least partially disposed within a corresponding recess in said frame and capable of producing an actuation force; and a drive spindle having an axis of rotation that is substantially coaxial to the axis of rotation of said actuator slat and a tongue that is disposed substantially within the receiving pocket of said actuator slat and being configured to transmit the actuating force from said electronic actuating device to said actuator slat.

13. An electronically actuated shutter assembly as defined in claim 12, further comprising at least one control bar which synchronizes rotational movement of the actuator slat with one or more other slats.

14. An electronically actuated shutter assembly as defined in claim 12, further comprising rotation control means for causing the electronic actuating device, in combinations with the drive spindle to rotate the actuator slat into a desired angle of inclination.

15. An electronically actuated shutter assembly as defined in claim 12, further comprising a timer capable of selectively actuating the electronic actuating device at a selected time.

16. An electronically actuated shutter assembly as defined in claim 12, further comprising a remote control capable of actuating the electronic actuating device from a remote location.

17. An electronically actuated shutter assembly as defined in claim 12, further comprising a photosensitive switch capable of actuating the electronic actuating device in response to changes in intensity of light.

18. An electronically actuated shutter assembly as defined in claim 12, further comprising a switch capable of actuating the electronic actuating device in response to mechanical action of the switch.

19. An electronically actuated shutter assembly as defined in claim 12, further comprising means for fixing the actuator slat in a desired angle of inclination upon deactivating the electronic actuating device.

20. An electronically actuated shutter assembly as defined in claim 12, further comprising disengagement means for allowing manual rotation of the actuator slat upon deactivation of the electronic actuating device.

21. An electronically actuated shutter assembly as defined in claim 12, further comprising a relay system capable of selectively actuating a plurality of electronic actuating devices.

22. An electronically actuated shutter assembly as defined in claim 12, wherein the electronic actuation device is at least partially housed within an encasement configured to provide structural reinforcement of a region of the frame adjacent the corresponding recess within which the electronic actuation device is at least partially disposed.

23. An electronically actuated shutter assembly as defined in claim 12, wherein the electronic actuation device comprises an electronic motor.

24. An electronically actuated shutter assembly as defined in claim 12, wherein the plurality of slats are substantially horizontally oriented.

25. An electronically actuated shutter assembly as defined in claim 12, wherein the plurality of slats are substantially vertically oriented.

26. An electronically actuated shutter assembly comprising:

a frame defining an interior region;

a plurality of slats rotatably disposed within the interior region of the frame, at least one of the slats comprising an actuator slat located within a middle third of the slats and having an axis of rotation;

a control bar interconnecting the actuator slat and at least one other of the slats being configured so as to provide for substantially synchronous movement of the actuator slat with the at least one other of the slats;

an electronic actuating device at least partially disposed within a corresponding recess in the frame and being capable of producing actuation forces; and a drive spindle communicating between the electronic actuating device and the actuator slat which converts the actuation forces produced by the electronic actuating device into desired rotational movement of the actuator slat, wherein the drive spindle has an end configured so as to mate with a corresponding recess of the selected slat and an axis of rotation that is substantially coaxial with the axis of rotation of the actuator slat.

27. An electronically actuated shutter assembly as defined in claim 26, wherein the electronic actuating device is housed within an encasement configured to provide structural reinforcement of a region of the frame adjacent the corresponding recess of the frame within which the electronic actuating device is at least partially disposed.

28. An electronically actuated shutter assembly as defined in claim 26, wherein the drive spindle further includes a tongue disposed at an end thereof which is mated within the corresponding recess in the actuator slat.

* * * * *